United States Patent [19]

Merton et al.

[11] 4,401,272

[45] Aug. 30, 1983

[54] AEROSOL FAN SPRAYHEAD

[75] Inventors: Wilfred R. Merton, Stillwater; Jerome A. Pieterick, St. Paul, both of Minn.

[73] Assignee: Minnesota Mining and Manufacturing Company, St. Paul, Minn.

[21] Appl. No.: 378,789

[22] Filed: May 17, 1982

[51] Int. Cl.[3] ..... B65D 83/14

[52] U.S. Cl. ..... 239/337; 222/402.24; 222/547; 239/590.3; 239/590.5; 239/592; 239/599

[58] Field of Search ..... 239/337, 592, 594, 595, 239/599, 601, 590.3, 590.5; 222/189, 402.1, 402.24, 547, 564, 566, 567

[56] References Cited

U.S. PATENT DOCUMENTS 2,968,441 1/1961 Holcomb ..... 239/337

3,000,576 9/1961 Levey et al. ..... 239/590.3 X 4,030,667 6/1977 Le Guillou ..... 239/590.3 X

*Primary Examiner*—Andres Kashnikow

*Attorney, Agent, or Firm*—Cruzan Alexander; Donald M. Sell; David W. Anderson

[57] ABSTRACT

An aerosol sprayhead assembly which includes a restriction between a sprayhead inlet communicating with an aerosol container and a nozzle opening which produces a fan-shaped spray pattern. The restriction acts in cooperation with the nozzle opening to provide a more uniform spray than may be achieved using an otherwise identical sprayhead which does not include the restriction. In one embodiment of the invention, the restriction defines an orifice formed as part of the sprayhead. In another embodiment, the restriction defines a single orifice or a plurality of orifices located within an outlet tube terminating in the nozzle opening. In a further embodiment of the invention, the restriction defines an integral reduced cross-section portion of the outlet tube.

14 Claims, 11 Drawing Figures

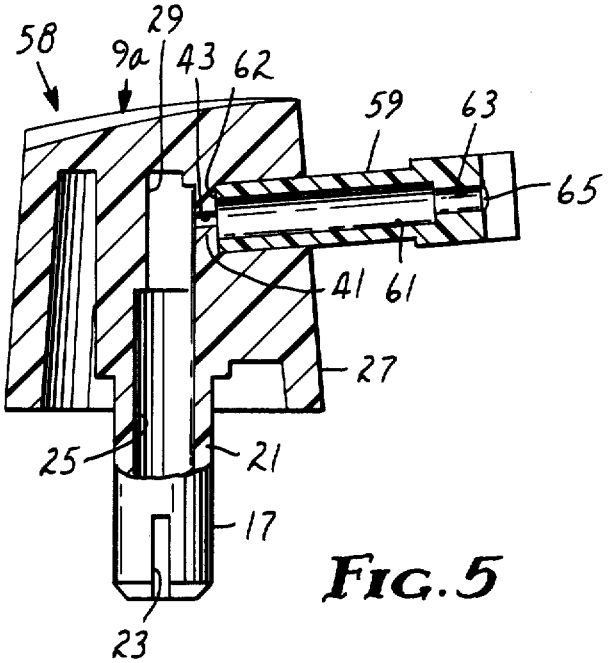
FIG. 5
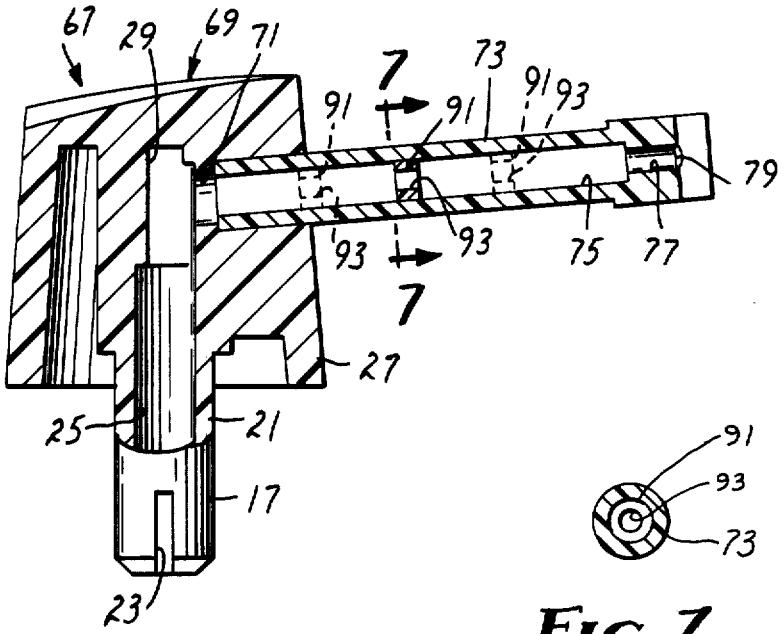
FIG. 6
FIG. 7

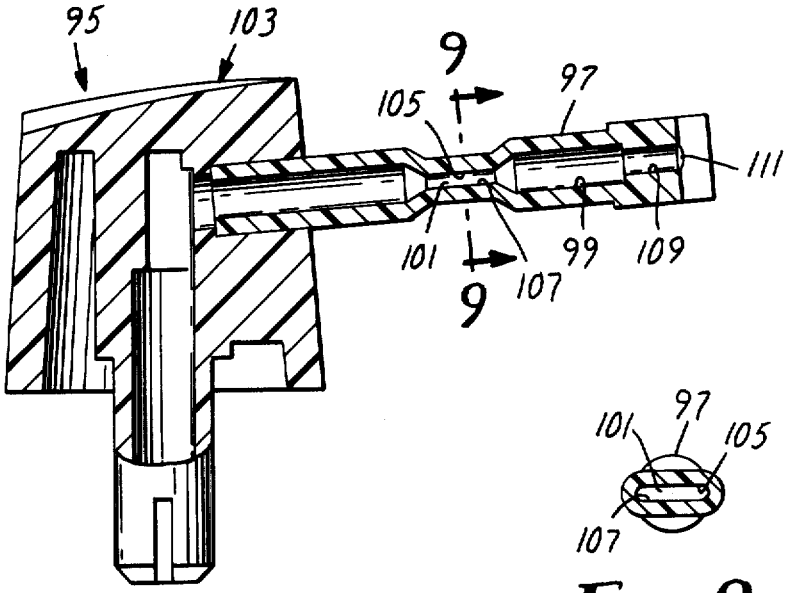
FIG. 8
FIG. 9
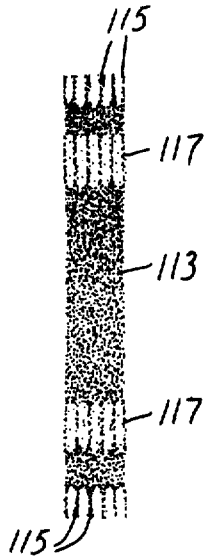
FIG. 10
PRIOR ART
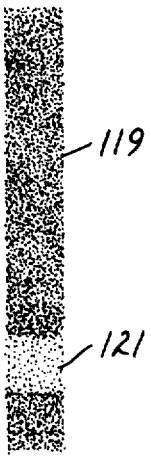
FIG. 11

AEROSOL FAN SPRAYHEAD

BACKGROUND OF THE INVENTION

1. Technical Field of the Invention

This invention relates to aerosol sprayheads and, in particular, sprayheads utilized to dispense cohesive polymer solutions in a fan spray pattern.

2. Description of the Prior Art

Small volume applications of elastomeric adhesive materials are most conveniently applied by aerosol spraying. In many applications this convenience is enhanced if the adhesive is sprayed in a "fan" spray pattern rather than a circular spray pattern since the fan pattern produces more uniform coverage across the width of the pattern.

Dispersions of elastomers (e.g., crosslinked nitrile rubbers, crosslinked butyl rubbers, and neoprene graft copolymers) have been sold in aerosol containers equipped with fan sprayheads. It is desirable, however, to be able to spray solutions of elastomers, as opposed to dispersions, because dispersions pose a settling problem which is not encountered with solutions, and because soluble polymers offer higher adhesion strengths and resist elevated temperatures better than crosslinked polymers.

Until recently, however, it has not been possible to produce commercially acceptable aerosol containers filled with solutions of elastomeric adhesives because it has not been possible to obtain acceptable spray patterns from aerosols containing more than a few percent adhesive solids in solution. This is because the polymer structure of the elastomeric adhesive solutions has extensive chain entanglements, or in other words, a high solution viscosity. In general, if a polymer has a number average molecular weight above about 10,000 and generates a solution having non-Newtonian viscoelastic properties, it has been difficult to spray from an aerosol container.

Recently, however, U.S. application Ser. No. 282,243, assigned to the assignee of the present invention, and incorporated herein, disclosed an aerosol sprayhead nozzle structure which enabled the formulation of aerosol adhesives based on soluble elastomers which, in turn, produced approximately two and one-half times the area coverage as compared to the best commercially available aerosol fan sprayhead. The sprayhead of U.S. Ser. No. 282,243 permitted an aerosol solids level as high as 11.1 percent, which would provide enough adhesive in a 16 fl. oz. (480 $cm^3$) container to cover two surfaces of an area of 99.3 square feet (9.23 square meters), while the best commercially available aerosol fan sprayhead was able to produce an acceptable fan spray pattern at levels no higher than 4.4 percent aerosol solids using the same adhesive formulation, which would provide an amount of adhesive in the same size container sufficient to cover two surfaces of an area of only about 39.4 square feet (3.66 square meters).

The improved nozzle structure permits adhesives in solution to be sprayed in an acceptable pattern at typical aerosol container pressures of between approximately mately 20 psi (0.14 megapascals) and 100 psi (0.69 megapascals), as opposed to the approximately 2,000 psi (13.8 megapascals) necessary when such solutions of elastomeric adhesives are sprayed using airless spray gun equipment. It is thought that this ability to spray at low pressures and the dramatic difference in pressures is at least partially attributable to the fact that in aerosol applications the propellant is in solution and a portion of the propellant is sprayed along with the adhesive solution.

The sprayhead of application Ser. No. 282,243, however, has not proven to be the total answer to the problem of spraying solutions of elastomeric adhesives. The spray pattern produced has not been completely uniform in that areas of light coverage and "tails" (sharply defined, stringy margins) are produced, and the spray nozzle cannot adequately cope with normal milling variations of the rubber and variations in the solids content of the adhesive solution.

SUMMARY OF THE INVENTION

The present invention improves the uniformity of a fan-shaped spray pattern produced by an aerosol sprayhead assembly when spraying solutions of elastomeric adhesives at low pressures and increases the tolerance of the sprayhead for milling variations of the solids comprising the aerosol solution by providing a restriction in the flow path of the solution upstream of the sprayhead assembly's nozzle opening.

In one embodiment of the invention, the restriction is formed as part of the sprayhead and defines an orifice communicating with an outlet tube which terminates in the nozzle opening. In another embodiment, the restriction defines a single orifice or a plurality of orifices located within the outlet tube. In yet another embodiment of the invention, the restriction defines a rectangular orifice located in the outlet tube.

BRIEF DESCRIPTION OF THE DRAWINGS

The present invention will be more thoroughly described with reference to the accompanying drawings wherein like numbers refer to like parts in the several views and wherein:

FIG. 5 is an elevational view, partially in section, of a second embodiment of a sprayhead assembly according to the present invention;

FIG. 6 is an elevational view, partially in section, of a third embodiment of a sprayhead assembly according to the present invention which illustrates an orifice plate in solid lines and additional orifice plates in phantom lines;

FIG. 7 is a sectional view taken generally along the line 7—7 of FIG. 6;

FIG. 8 is an elevational view, partially in section, of a fourth embodiment of a sprayhead assembly according to the present invention;

FIG. 9 is a sectional view taken generally along the line 9—9 of FIG. 8;

FIG. 10 is an illustration of a spray pattern produced by a sprayhead assembly of the prior art; and FIG. 11 is an illustration of a spray pattern produced by a sprayhead assembly utilizing an embodiment of the present invention.

DETAILED DESCRIPTION OF THE INVENTION

Figure 1:
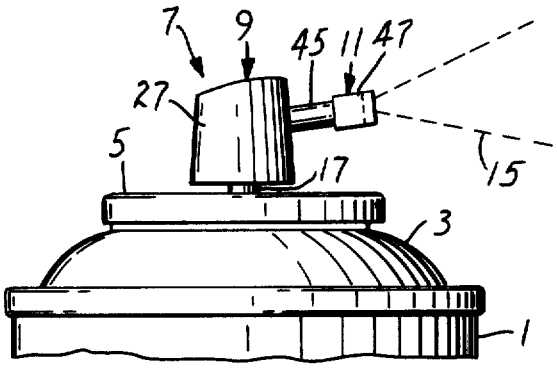
FIG. 1 is an elevational view of a portion of an aerosol container equipped with a sprayhead assembly according to the present invention.

Referring now to FIG. 1, there is shown a conventional aerosol container 1, such as is commercially available from the American Can Company, which includes a neck portion 3 in which is mounted a valve 5 which may be one of many types well known in the art, such as those available from Newman-Green Incorporated. The valve 5 includes a dip tube (not shown) which extends to the bottom of the container 1 in order that the entire contents of the container 1 may be used.

A sprayhead assembly 7 embodying the present invention is inserted into the container valve 5 and includes a sprayhead 9 and a nozzle outlet tube 11 having interconnected through-passageways terminating in an elongate nozzle opening 13 through which the contents of the container 1 may flow to form a spray 15. The sprayhead 9, best seen in FIG. 2, includes an inlet stem 17 and a transversely oriented outlet bore 19. The inlet stem 17 has a cylindrical wall 21 which is cut in its lower region to form a metering slot 23. The inlet stem 17 serves to actuate the container valve 5 when the sprayhead 9 is depressed, and the metering slot 23 regulates the flow of the container 1 contents into the sprayhead 9. The contents of the container 1 flow through the metering slot 23 into a cylindrical inlet passgeway 25 formed by the cylindrical wall 21 and the body 27 of the sprayhead 9. The passageway 25 terminates in a cylindrical chamber 29 which is intersected by and communicates with the outlet bore 19.

The foregoing structure is conventional and the most common industry construction. If desired, however, the inlet stem may be incorporated into the container valve and the sprayhead provided with a female inlet. Either construction may be used in conjunction with the present invention.

The sprayhead 9 may be either machined or molded from any suitable material including metal or plastic, but preferably is molded in plastic due to cost considerations and the ability of plastic to resist chemical attack.

FIGS. 1-4 illustrate the preferred embodiment of the invention in which a restriction 41 having an orifice 43 is incorporated between the cylindrical chamber 29 and the outlet bore 19. The restriction 41 is preferably molded as an integral part of the sprayhead body 27, but may be adhesively bonded or welded in place. The restriction 41 is formed as an annular ring defining the central orifice 43 which has a cross-sectional area less than either the inner cross-sectional area of the outlet tube 11 or the cross-sectional area of the inlet passageway 25 and which is approximately equal to the cross-sectional area of the nozzle opening 13.

The nozzle outlet tube 11 includes a cylindrical body portion 45 press fitted into the outlet bore 19 to contact the restriction 41 and a flattened tip portion 47 in which the nozzle opening 13 is formed. The nozzle opening 13 is formed by the intersection of a cylindrical outlet passageway 49 extending centrally through the outlet tube 11 and a transverse tapered groove 51.

The preferred diametrical dimension of the orifice 43 has been empirically determined to be 0.040 inches (1.0 mm) when used in conjunction with an outlet passageway 49 having a diameter of 0.059 inches (1.5 mm). The preferred length of the outlet passageway 49 is approximately 0.580 inches (14.7 mm). The outlet passageway 49 terminates in a conical taper 53 having an included angle of approximately 90°, and the nozzle opening 13 is formed by transversely intersecting the outlet passageway taper 53 with the tapered groove 51 having sides 55 and 57 disposed at an included angle of approximately 90°. The groove 51 intersects the outlet passageway taper 53 to a depth substantially equal to the length of the taper 53. The elongate opening 13 thus formed, and best seen in FIG. 3, has a substantially longer dimension along the groove 51 than transverse to the groove 51.

Figure 3:
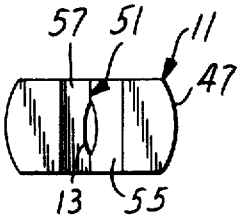
FIG. 3 is an end view of an outlet tube portion of the sprayhead of FIG. 1.
Figure 2:
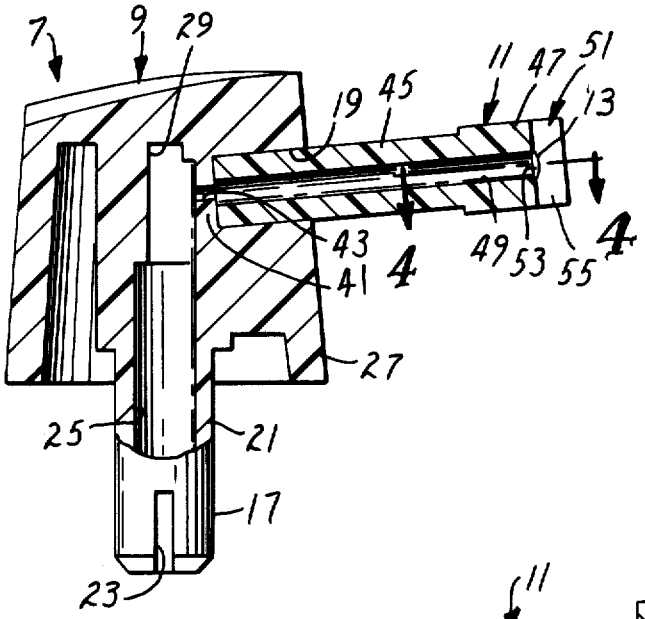
FIG. 2 is an elevational view, partially in section, of the sprayhead assembly of FIG. 1.
Figure 4:
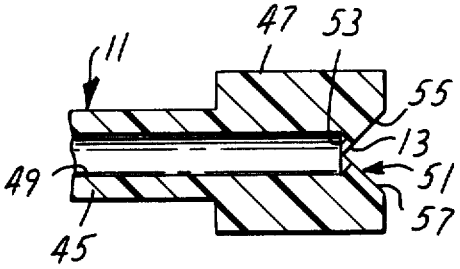
FIG. 4 is a fragmentary sectional view taken generally along the line 4—4 of FIG. 2.

Although the nozzle opening 13 and the sprayhead tip 47 shape illustrated in FIGS. 2-4 are believed to produce the most desirable fan spray pattern, many other nozzle openings and tip shapes may be useful. These alternatives are illustrated and explained in depth in U.S. application Ser. No. 282,243.

FIG. 5 illustrates a second embodiment of a sprayhead assembly 58 according to the present invention which includes a sprayhead **9*a* identical to the sprayhead 9 illustrated in FIG. 2 and an outlet tube 59 which has an outlet chamber 61 which extends from the end 62 of the outlet tube 59 contacting the restriction 41 to an outlet passageway 63 which communicates between the outlet chamber 61 and a nozzle opening 65 which is of the same size and shape as the nozzle opening 13**.

An outlet chamber 61 having a diameter of 0.076 inches (1.9 mm) and a length of 0.5 inches (12.7 mm) used in conjunction with an outlet passageway 63 having a diameter and length of 0.059 inches (1.5 mm) and 0.080 inches (2 mm), respectively, has been found to produce an acceptable fan spray pattern very nearly as uniform as that produced by the sprayhead assembly 7 of FIG. 2.

FIG. 6 illustrates yet another embodiment of a sprayhead assembly 67 according to the present invention which also improves the uniformity of the fan spray pattern and better accommodates milling variations of the rubber and variations in the solids content of the adhesive solution. In this embodiment, a sprayhead 69 is included which is generally the same as the sprayheads 9 and **9*a* described above, except that the sprayhead 69 has an annular shoulder 71 in place of the restriction 41, which serves merely to limit the travel of an outlet tube 73 as it is inserted into the sprayhead 69. The outlet tube 73 includes an outlet chamber 75, an outlet passageway 77 and a nozzle opening 79 which are identical in all respects to the outlet chamber 61, outlet passageway 63 and nozzle opening 65 of the sprayhead assembly 58 of FIG. 5 except that the length of the outlet tube 73 is increased to accommodate an outlet chamber 75 0.870 inches (22.1 mm) in length. Centered along the length of the outlet chamber 75 is a restriction 91 formed as an annular plate which includes an orifice 93 coaxial with the outlet passageway 77 and the nozzle opening 79. The plate 91 is preferably made of plastic, as is the outlet tube 73, and is secured within the outlet chamber 75 either by press fitting, adhesive bonding or welding. Suitable dimensions for the plate 91 and the orifice 93** have been found to be 0.040 inches (1 mm) in width and 0.050 inches (1.25 mm) in diameter, respectively.

When spraying particularly viscous solutions, it has been found that spray pattern uniformity may be enhanced by providing more than one plate 91 within the outlet chamber 75. In this instance, a plurality of plates 91 (indicated in phantom lines) may be inserted into the outlet chamber 75 and spaced equally from each other and the ends of the outlet chamber 75. Although one and three plates 91 have been illustrated, two plates 91 produce acceptable results and it is contemplated that more than three plates 91 could be employed if located symmetrically within the chamber 75 and spaced equally from each other and the ends of the outlet chamber 75.

A final embodiment is illustrated in FIGS. 8 and 9 which show a sprayhead assembly 95 including an outlet tube 97 which has a length so as to provide an outlet chamber 99 having a diameter of 0.076 inches (1.9 mm) and a length of 0.870 inches (22.1 mm). The tube 97 is crimped or molded to form a rectangular orifice 101 the longitudinal center of which is located 0.440 inches (11 mm) from the end of the outlet tube 97 inserted in a sprayhead 103. The orifice 101 is approximately 0.080 inches (2 mm) in length, and as best seen in FIG. 9, is rectangular with rounded ends in cross-section and has a dimension between flat surfaces 105 and 107 of 0.030 inches (0.75 mm). In this instance the dimensions and shapes of the associated sprayhead 103, outlet passageway 109 and nozzle opening 111 are the same as the sprayhead 69, outlet passageway 77 and nozzle opening 79 of FIG. 6. The embodiment of FIG. 8 has been shown to produce an acceptable fan spray pattern and may additionally provide the advantage of reduced cost.

FIG. 10 and 11 illustrate the efficacy of providing an orifice 43, 93 or 101 located within the sprayhead assembly 7, 58, 67 or 95 between the container 1 and the nozzle opening 13, 65, 79 or 111. FIG. 10 illustrates a portion of a fan spray pattern 113 produced by a prior art sprayhead assembly of U.S. application Ser. No. 282,243, as it would appear when sprayed from above onto a horizontal surface from a container 1 held at approximately 45° with the nozzle opening approximately 6 inches (150 mm) from the surface.

The spray pattern 113 is distinguished by sharply defined and stringy margins or "tails" 115 on both ends, and areas of light coverage 117 toward the ends of the pattern 113. Also, the amount of material sprayed is found to be much heavier toward the top of the pattern 113 than toward the bottom.

FIG. 11 illustrates a fan spray pattern 119 produced under the same conditions by a sprayhead assembly 7, 58, 67 or 95 including any of the orifices 43, 93 or 101 illustrated by FIGS. 2, 5, 6 or 8. The spray pattern 119 of FIG. 11 is distinguished from the spray pattern 113 of FIG. 10 by the absence of tails 115 and much less severe areas of light coverage 117. There is generally found to be one area of light coverage 121 located in the bottom half of the spray pattern 119, but this area 121 is found to contain more sprayed material than the areas of light coverage 117 in the spray pattern 113 of FIG. 10. In addition, the spray pattern 119 produced when an orifice 43, 93 or 101 is used has been found to be more uniform end-to-end than the spray pattern 113 produced by a sprayhead assembly not containing an orifice 43, 93 or 101.

The difference between the spray patterns 113 and 119 of FIGS. 10 and 11 are borne out by the following examples which offer comparisons between the fan spray patterns 119 produced by the various embodiments of the sprayhead assemblies 7, 58, 67 and 95 described herein and a fan spray pattern 113 produced by a sprayhead assembly containing no orifice 43, 93 or 101. These examples are offered to aid understanding of the present invention and are not to be construed as limiting the scope thereof.

EXAMPLES 1-7

A solution of polychloroprene contact adhesive in methylene chloride was prepared using the ingredients and amounts shown below in TABLE I.

TABLE I

| Ingredient | Weight, ounces (grams) |
|---|---|
| 60 to 80 Mooney viscosity polychloroprene copolymer[1] | 0.24 (6.8) |
| t-Butyl phenolic resin[2] | 0.12 (3.4) |
| Magnesium oxide[3] | 0.05 (1.4) |
| Water | 0.0025 (0.07) |
| Methylene chloride | 2.4 (68.4) |

[1]"Neoprene AC", commercially available from E. I. du Pont de Nemours Co., milled 5 minutes on a two-roll mill.
[2]"CKR 1634", commercially available from Union Carbide Co.
[3]"Maglite A", commercially available from Merck Chemical Co.

This formulation was placed in a Model 202×406 aerosol container 1, commercially available from the American Can Company, and capped with a Model R10-123 can valve 5 available from Newman-Green Incorporated. The container 1 was filld with 0.85 ounces (24 g) of dimethyl ether through the valve 5, thereby providing an 11.1 percent aerosol solids level in the container 1. The pressue inside the aerosol container 1 reached approximately 25 psi (0.17 megapascals). The sprayhead assemblies 7, 58, 67 and 95 of FIGS. 2, 5, 6 and 8 and the prior art sprayhead assembly of U.S. application Ser. No. 282,243 were then sequentially placed on the container valve 5 and for each the container 1 was held at an angle of approximately 45° with the nozzle opening 13, 65, 79 or 111 approximately 6 inches (150 mm) above a foil sheet located on a horizontal surface. The above-identified solution was sprayed on the foil and allowed to dry, after which the spray pattern was cut into five equal widths, each comprising 20% of the pattern dimension transverse to the direction of sprayhead motion. Each width was weighed, the material removed with a solvent, and the widths then dried and re-weighed to obtain the amount of adhesive material originally on each width.

In this manner the uniformity of the spray pattern 119 produced by each of the embodiments of the present invention could be compared to each other and to the prior art sprayhead assembly of U.S. application Ser. No. 282,243. The results of those comparisons are set out below in TABLE II which includes the example number, the sprayhead assembly 7, 58, 67 or 95 identified by Figure Number and the amount of material in one-fifth of the spray pattern expressed as a percentage of the total amount of material sprayed.

TABLE II

| Ex. No. | Sprayhead Assembly (FIG. No.) | Material in One-Fifth of Spray Pattern Width (% of total) Away from Container → Toward Container | | | | |
|---|---|---|---|---|---|---|
| 1 | 2 | 18.3 | 11.9 | 23.9 | 22.0 | 23.9 |
| 2 | 5 | 22.6 | 23.8 | 23.8 | 10.7 | 19.0 |
| 3 | 6 (one orifice) | 23.8 | 22.6 | 25.0 | 10.7 | 17.9 |
| 4 | 6 (two orifices) | 19.1 | 12.4 | 20.2 | 18.0 | 30.3 |
| 5 | 6 (three orifices) | 11.0 | 11.0 | 15.1 | 39.7 | 23.3 |
| 6 | 8 | 25.8 | 16.5 | 18.6 | 13.4 | 25.8 |
| 7 | Prior Art | 34.3 | 32.4 | 12.7 | 7.8 | 12.5 |

A perfect spray pattern would result in each one-fifth of the spray pattern containing exactly 20 percent of the total amount of material sprayed. While none of the sprayhead assemblies 7, 58, 67 and 95 reached this level of perfection, the examples show that a sprayhead assembly 7, 58, 67 or 95 containing any one of the embodiments of the orifice 43, 93 or 101 described above produced a more uniform fan spray pattern than did the sprayhead assembly of the prior art which contained no orifice.

While the present invention has been described in connection with certain specific embodiments, it is to be understood that the invention is not to be limited to those embodiments. On the contrary, the invention is intended to cover all alternatives and modifications falling within the spirit and scope set forth in the appended claims.

We claim:

1. In the combination of an aerosol container including a valve and a sprayhead assembly including a generally cylindrical inlet stem having an inlet end portion slideably and sealably mounted in the valve and an outlet end portion, a central passageway between said inlet and outlet end portions, and at least one fluid metering passage through the side wall of said stem proximate said inlet end portion and communicating with the central passageway and a nozzle portion attached to the outlet end portion of the stem, the nozzle portion having an elongate groove which defines a terminal surface for the nozzle portion, the groove having a major axis, the nozzle portion further having an elongate chamber extending generally transverse to the stem with a central axis, and outlet end, and an inlet end communicating with the central passageway, and an orifice communicating with the outlet end of the elongate chamber and opening through the terminal surface, the orifice forming an elongate intersection with the terminal surface as viewed along the central axis, being generally centered in the groove, and having a major axis which is generally aligned with the major axis of the groove, wherein the major axis of the groove is longer than the major axis of the orifice, the container being filled with a solution of a polymer having a minimum number average molecular weight of approximately 10,000 and a solvent, the percentage by weight of the polymer in the solution being a value at which the solution exhibits non-Newtonian viscoelastic properties, and a propellant which generates a relatively low pressure within the can and is sprayed with the solution in a fan-shaped pattern by slidingly depressing the sprayhead into the valve, the improvement comprising:

restriction means disposed between said inlet end portion and said orifice and having a cross-sectional area substantially less than that of said inlet passageway, said inlet chamber or said outlet passageway for increasing uniformity of said spray pattern.

2. An aerosol container and sprayhead combination according to claim 1 wherein said adhesive and propellant solution is contained at a pressure below 200 psi (1.36 megapascals).

3. An aerosol container and sprayhead combination according to claim 1 further including a V-shaped groove oriented transverse to said outlet passageway defining a terminal outer surface of said outlet tube and a conical taper defining a terminal inner surface of said outlet passageway which intersect to produce said elongate nozzle opening.

4. An aerosol container and sprayhead combination according to claim 1 or 3 wherein said outlet tube is oriented substantially perpendicular to said inlet passageway.

5. An aerosol container and sprayhead combination according to claim 4 wherein said outlet tube is oriented at an included angle of between 90 and 120 degrees with respect to said inlet passageway.

6. An aerosol container and sprayhead combination according to claim 1 wherein said restriction means defines an orifice coaxial with said outlet passageway.

7. An aerosol container and sprayhead combination according to claim 6 wherein said restriction means is disposed between said inlet chamber and said outlet tube.

8. An aerosol container and sprayhead combination according to claim 7 wherein said restriction means is formed as an integral part of said sprayhead.

9. An aerosol container and sprayhead combination according to claim 1 further including an outlet chamber coaxial with said outlet passageway disposed within said outlet tube and having a cross-sectional area substantially greater than that of said outlet passageway.

10. An aerosol container and sprayhead combination according to claim 9 wherein said restriction means defines an orifice coaxial with said outlet passageway disposed between said inlet chamber and said outlet tube and wherein said outlet chamber extends to said restriction means to communicate directly with said orifice.

11. An aerosol container and sprayhead combination according to claim 9 wherein said restriction means defines an orifice coaxial with said outlet passageway disposed within said outlet chamber.

12. An aerosol container and sprayhead combination according to claim 9 wherein said restriction means defines a plurality of orifices coaxial with each other and said outlet passageway disposed within said outlet chamber and equally spaced from each other along said outlet chamber.

13. An aerosol container and sprayhead combination according to claim 9 wherein said restriction means defines an orifice having a substantially rectangular cross-section disposed within said outlet chamber and centered with respect to the cross-section of said outlet chamber.

14. An aerosol container and sprayhead combination according to claim 6, 7, 10, 11 or 12 wherein said orifice or orifices have a circular cross-section of an area substantially equal to that of said nozzle opening.

* * * * *